US008303257B2

(12) United States Patent
Heinz-Schwarzmaier et al.

(10) Patent No.: US 8,303,257 B2
(45) Date of Patent: Nov. 6, 2012

(54) SHIPLAP ARRANGEMENT

(75) Inventors: Thomas Heinz-Schwarzmaier, Wettingen (CH); Ulrich Rathmann, Baden (CH); Carlos Simon-Delgado, Baden (CH)

(73) Assignee: ALSTOM Technology Ltd, Baden (CH)

( * ) Notice: Subject to any disclaimer, the term of this patent is extended or adjusted under 35 U.S.C. 154(b) by 262 days.

(21) Appl. No.: 12/572,034

(22) Filed: Oct. 1, 2009

(65) Prior Publication Data

US 2010/0119371 A1 May 13, 2010

Related U.S. Application Data

(63) Continuation of application No. PCT/EP2008/053482, filed on Mar. 25, 2008.

(30) Foreign Application Priority Data

Apr. 5, 2007 (CH) ..... 0572/07

(51) Int. Cl.
*F01D 11/02* (2006.01)
*F01D 5/22* (2006.01)

(52) U.S. Cl. ..... 416/190; 416/191; 415/139; 277/418; 277/419; 277/631; 277/632; 277/649

(58) Field of Classification Search ..... 415/138–139, 415/191, 208.2, 209.3, 209.4, 210.1; 416/190–191, 416/194, 195, 196 R, 193 R, 500; 277/411–412, 277/418–420, 628, 631–632, 644, 648–649, 590

See application file for complete search history.

(56) References Cited

U.S. PATENT DOCUMENTS

| | | | | | |
|---|---|---|---|---|---|
| 3,279,802 | A * | 10/1966 | Carre | 277/420 |
| 4,623,298 | A * | 11/1986 | Hallinger et al. | 415/139 |
| 5,257,908 | A * | 11/1993 | Ortolano | 416/191 |
| 6,155,574 | A * | 12/2000 | Borgstrom et al. | 277/419 |
| 6,270,311 | B1 * | 8/2001 | Kuwabara et al. | 415/139 |
| 6,425,738 | B1 * | 7/2002 | Shaw | 415/209.2 |
| 2002/0090296 | A1 * | 7/2002 | Kuwabara et al. | 415/169.1 |
| 2004/0067131 | A1 * | 4/2004 | Joslin | 415/139 |
| 2004/0080113 | A1 * | 4/2004 | Linden et al. | 277/412 |

* cited by examiner

*Primary Examiner* — Christopher Verdier
(74) *Attorney, Agent, or Firm* — Volpe and Koenig, P.C.

(57) ABSTRACT

An arrangement between blade elements in a blade row in a turbine is described. Each blade element has at least one shroud element and a blade airfoil which abuts on, and is connected to, the shroud element, and essentially extends radially with regard to a principal axis of the blade row. When installed, the shroud element sides, which extend circumferentially, abut on the respectively adjacent shroud element of the respectively adjacent blade element, each forming an essentially radial gap. At least one blade element has a projection which projects into the shroud element of the abutting blade element and extends in the circumferential direction, and at least one blade element has a recess which accommodates such a projection. In the region of the projection or recess there is a stepped region of the radial gap, and the guiding of the radial gap in this stepped region is a labyrinth seal.

22 Claims, 4 Drawing Sheets

SHIPLAP ARRANGEMENT

FIELD OF INVENTION

The present invention refers to an arrangement between two adjacent shroud elements at the trailing edge of turbine blades in a turbine, especially a gas turbine, especially preferably in a low-pressure gas turbine.

BACKGROUND

Conventional sealing means for sealing interspaces, such as rubber seals, polymer seals, adhesive means, or engaging of a projection in a slot, as are especially to be encountered in the case of the seal between two static elements, are generally known. In gas turbines, a wide variety of elements are cooled by means of a cooling air flow for avoiding heat damage. This cooling air flow is to be effected with the lowest losses possible in order to maximize the cooling potential. A plurality of types of sealing for sealing interspaces in gas turbines are known from the field of the present invention (for example GB 2 420 162, U.S. Pat. No. 5,797,723). Such types of sealing, however, in gas turbines between two components which are movable relative to each other, such as between a rotor element and a stator element, or between two components which must have a certain clearance, are poor in application.

In order to achieve an efficient seal between two blade elements in a gas turbine, for example in order to prevent the loss of cooling air as a result of a leakage flow, a precise matching of the blade elements to each other is necessary. If, however, the wish is to make a certain "clearance" possible for the abutting components, which is indispensable for example between two rotor blades in a rotor of a gas turbine on account of the intense flow around the blade elements by hot operating medium during operation, a precise, clearance-free matching of two adjacent shrouds of blade elements is almost impossible since such a compact type of construction, as would be necessary for the complete sealing of the radial gap, can lead to problems, for example on account of thermal expansion. Also, the effect of centrifugal forces between the components after installation can be considerable, which can lead to severe wear of conventional sealing means (as is described for example in DE 199 31 765 A1). For these reasons, so-called "shiplaps" are used between blades in a gas turbine rotor according to conventional design for sealing the leakage flow in the axial direction. "Shiplaps" constitute a thermally resistant sealing means since they are designed essentially from the material of the blade elements themselves, form an integral component part of the blade elements, and therefore enable a sealing effect without additional material which is possibly sensitive to heat or has a different coefficient of thermal expansion.

Turbine blades, especially low-pressure turbine blades, in most cases have at least one shroud element radially on the inside and/or radially on the outside, which, with the blade row installed, abut on the respectively adjacent shroud element of the respectively adjacent blade element by the two sides of the shroud element which point in the circumferential direction, forming in each case an essentially radial gap. Such a turbine blade element, on at least one axial edge, especially the trailing edge, on a first side which points in the circumferential direction, can have a projection which extends in the circumferential direction and projects into the shroud element of the abutting blade element, and on a second side which points in the circumferential direction can have a recess which accommodates this projection.

The sequential installation of such blade elements leads in each case to the forming of a so-called "shiplap" between two blade elements. Such a shiplap is an overlapping or engaging region, which is stepped in the flow direction of the operating gas, between the shroud element on an axial edge of a blade element and the shroud element on the same axial edge of the adjacent blade element. This shiplap seals the radially extending gap between the contiguous circumferential sides of two turbine blades against the escape of cooling air from the secondary air circuit, i.e. against the leakage flow in the axial direction. Such a shiplap comes into being as result of the covering of a recess on a first side, which points in the circumferential direction, of an adjacent blade element by means of a projection on the second side, which points in the circumferential direction, of a blade element, or by the engagement of the projection in the recess. In U.S. Pat. No. 6,966,750, such a projection, and also a recess and the stepped overlaying or engagement region which results during installation, are shown in FIG. 13. The known conventional shiplap, however, is not able to fully seal the radial gap, for which reason a significant amount of cooling air can escape as a result of the stepped overlapping region. This loss results in reduced efficiency and output of the turbine.

SUMMARY

The invention is accordingly based on the object of providing an improved arrangement which has an improved sealing effect compared with the shiplaps which are known from the prior art and, as a result, reduces the leakage flow from the secondary air circuit.

This is achieved by at least one labyrinth step being introduced into the shiplap. As a result, an arrangement with a labyrinth seal between turbine blades or rotor blades or stator blades is provided in a rotor and at the trailing edge reduces the escape of the cooling air which has flowed from the cooling air region into the radial gap of a low-pressure gas turbine.

Essentially, invention provides a labyrinth seal between two adjacent shrouds of a blade element. In the prior art, the principle of introducing such a labyrinth seal between two components, which in principle are static in relation to each other, is not known. Either an overlaying or engagement region, which is formed essentially with a zigzag shape, of two adjacent shroud elements on turbine blades with more than two changes of direction of the radial gap, or an overlaying or engagement region which utilizes the synergetic effect of narrowing and widening of the gap upon the vortex formation of the air which is in the gap, or an overlaying or engagement region of two adjacent shroud elements on turbine blades which has a constructional form which contains a combination of the two principles, is to be understood by a labyrinth seal in connection with this invention.

The principle of the labyrinth seal is indeed known from situations where components are mounted in a dynamically movable manner in relation to each other. A plurality of documents, such as U.S. Pat. No. 5,279,109 and U.S. Pat. No. 5,222,742, point to the fact that labyrinth seals in particular could reduce the leakage flow of cooling air in gas turbines and could therefore contribute to the improved cooling effect. Moreover, approaches for improving the design of labyrinth seals are known. So, for example U.S. Pat. No. 5,639,095 discloses a plurality of labyrinth steps which are connected in series. These improved labyrinth seals were developed in order to optimize the flow deflection, to reduce friction due to the "zigzag geometry" which occurs in simple labyrinth seals, and to achieve a maximum vortex movement and also improvement of the sealing effect. However, the destination of the application of such improved labyrinth seals in the said publications is always the flow passage between rotor and stator element of a gas turbine. All the preferred embodiments (FIGS. 3-18) are aimed at specific labyrinth seal systems with a geometry which corresponds to the sealing surfaces between rotor and stator and therefore at elements which during operation are dynamically movable relative to each other. The present invention, however, in contrast to this, refers to the seal between two blade elements, or between two adjacent elements, for example in a rotor, which are not dynamically movable towards each other but between which a certain "clearance" is necessary during operation of the gas turbine. This solution is therefore not obvious to the person skilled in the art.

Labyrinth seals were previously used only between two components which are movable relative to each other, such as a stator element and a rotor element. DE 39 40 607 and U.S. Pat. No. 5,222,742 disclose labyrinth seal systems between rotating and stationary components of a gas turbine. In DE 39 40 607, a labyrinth system is created as a result of the engaging of staggered long teeth in a stator sealing element and staggered recesses in the rotor sealing element, and also staggered short teeth of the rotor sealing element with staggered recesses of the stator sealing element. In this case, the geometry and inclination of the teeth is varied, which leads to gaps which throttle the kinetic energy of the throughflowing gas or steam with varying intensity. WO 2005/028812 A1 discloses an arrangement of stacked labyrinth seals for reducing leakage flow between fixed and rotating components, specifically a segmented inner ring for retaining stator blades in a stationary gas turbine.

The present invention, in an unobvious manner, transfers the principle of the stepped labyrinth seal to the problems of sealing a gap between shrouds of adjacent blade elements against leakage flow, especially in connection with a shiplap.

A first embodiment of the labyrinth seal is characterized in that provision is made for an arrangement between blade elements in a blade row in a gas turbine, wherein each blade element has at least one shroud element, and also a blade airfoil which abuts on, and is connected to, this shroud element, and extends essentially in the radial direction with regard to a principal axis of the blade row. With the blade row installed, the shroud element, by the two sides which point in the circumferential direction, abuts on the respectively adjacent shroud element of the respectively adjacent blade element, forming in each case an essentially radial gap. In this case, at least one blade element, on a first side which points in the circumferential direction, has a projection which projects into the shroud element of the abutting blade element and extends in the circumferential direction, and at least one blade element, on a second side which points in the circumferential direction, has a recess which accommodates such a projection. In the region of the projection or of the recess there is a stepped region of the radial gap, wherein the guiding of the radial gap in the stepped region, i.e. in the shiplap region, is designed as a labyrinth seal.

According to a further preferred embodiment, the radial gap in the stepped region has more than two changes of direction, especially four, six or eight changes of direction. However, arrangements with an odd number of changes of direction, for example 3, 5, 7 or more, are also quite easily conceivable.

A change of gap flow direction by 40 to 130 degrees, preferably by 60 to 110 degrees, especially preferably essentially by 80 to 100 degrees, but essentially especially by about 90 degrees in the case of angled boundary surfaces of the radial gap, is essentially understood as a change of direction. The gap flow direction is defined as the direction of the air flow in the radial gap which extends essentially constantly parallel to the shroud surface, wherein the air which comes from the leading edge for the time being flows in the axial direction towards the trailing edge, but after a change of direction can quite easily also flow obliquely or transversely to the inflow direction. In the case of rounded boundary surfaces, however, it can quite easily also be preferred to provide changes of direction of 40-80 degrees, or of 110-130 degrees. A change of direction has the purpose, according to the invention, of deflecting the gap flow of the air, which has inadvertently reached the radial gap from the cooling air region, in such a way that a pressure reduction takes place inside the stepping, wherein an additional flow resistance occurs inside the said stepping. As a result of the change of direction, vortices develop in the cooling air, especially when passing through narrowed gap sections. These vortices, during a following change of direction, are deflected and migrate since they cannot enter the next gap section. Vortices, which do not migrate in a direction which is oriented opposite the gap flow, at least partially dissipate again if they enter a widened region of the gap. As a result of such deflection of the gap flow and because of the vortex formation associated with it as a result of air flowing in different directions and the dissolution of such vortices, the cooling air, because of its own movement, is prevented from flowing uniformly with high mass flow. Due to the prevention of a high mass flow, less cooling air escapes from the radial gap at the axial edge.

According to a further preferred embodiment, the radial gap has angled and/or rounded boundary surfaces in the shiplap region. That is to say that the individual sections in the case of a change of direction can merge into each other in an angled or round manner at a specific angle. The boundary surfaces can be formed concave and/or convex, and/or straight.

According to a further preferred embodiment, the radial gap experiences two changes of direction in the same direction one after the other in each case during its course in the stepped region. That is to say, two changes of direction in the counterclockwise direction follow two changes of direction in the clockwise direction, and/or vice versa. This is particularly the case when the radial gap in the stepped overlapping or engagement region has a zigzag shape. An arrangement with such a zigzag geometry of the radial gap can have at least one section in the stepped region in which the gap flow direction runs opposite to the inflow direction.

Alternatively to the above embodiments or additionally to them, or in combination with them, it is possible and preferred for the radial gap to have at least one narrowing and/or at least one widening in the stepped region. A section of the radial gap with such a widening can be at least 30% more, preferably at least 50% more, than the width of the radial gap or than the throughflow cross section at the entry into the stepped region and can possibly even be twice as large as the throughflow cross section at the entry into the stepped region. In the section of a narrowing, the width of the radial gap or of the throughflow cross section is 75%-50%, preferably 50%-25%, of the gap width at the entry into the stepped region.

As seen in the direction from the first axial edge to the second axial edge, a widening and/or a narrowing can be arranged before and/or after a change of direction. For vortex formation, it is optimum if a widening in the gap flow direction of the air in the radial gap is arranged after a narrowing. However, a narrowing can also follow a widening again in order to increase the swirling effect. Also, the region of the change of direction, i.e. the region where the boundary surfaces of the radial gap merge into each other or onto each other in a round or angled manner at a specific angle, can be designed as a widening or narrowing in comparison to the entry region of the air into the stepped region. In a further preferred embodiment, such regions of the change of direction have rounded triangular regions (as seen from above with a view onto the plane of the shroud surface).

A further preferred embodiment according to the present invention is a blade row of a gas turbine with an arrangement according to one of the previously described embodiments. According to a further preferred embodiment of such a blade row, the radial gap between two adjacent shroud elements is covered on the shroud underside by a sealing plate. This sealing plate impedes the entry of air from the cooling air region into the radial gap and therefore initially minimizes on the whole the air volume which is to be blocked by the shiplap arrangement according to the invention at the outlet from the gap since as far as possible it should already be blocked by the sealing plate at the entry into the gap. Other sealing variants as alternatives to the sealing plate are not excluded in this case.

Further preferred embodiments of the invention are described in the dependent claims.

BRIEF DESCRIPTION OF THE DRAWINGS

The invention shall subsequently be explained in more detail based on exemplary embodiments in conjunction with the drawings. In the drawing:

FIGS. 1*a* and 1*b*: show the prior art; wherein FIG. 1*a* is a schematic view of an arrangement of turbine blades and FIG. 1*b* shows a detailed view of a shiplap;

DETAILED DESCRIPTION OF THE PREFERRED EMBODIMENTS

Figure 1B:
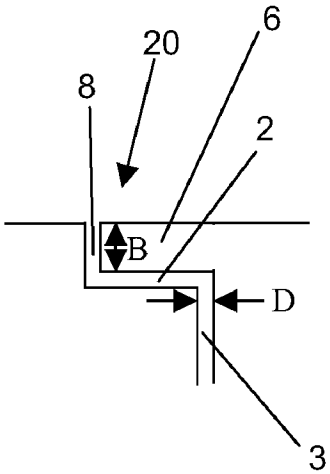
Fig. 1b (Prior Art)
Figure 1A:
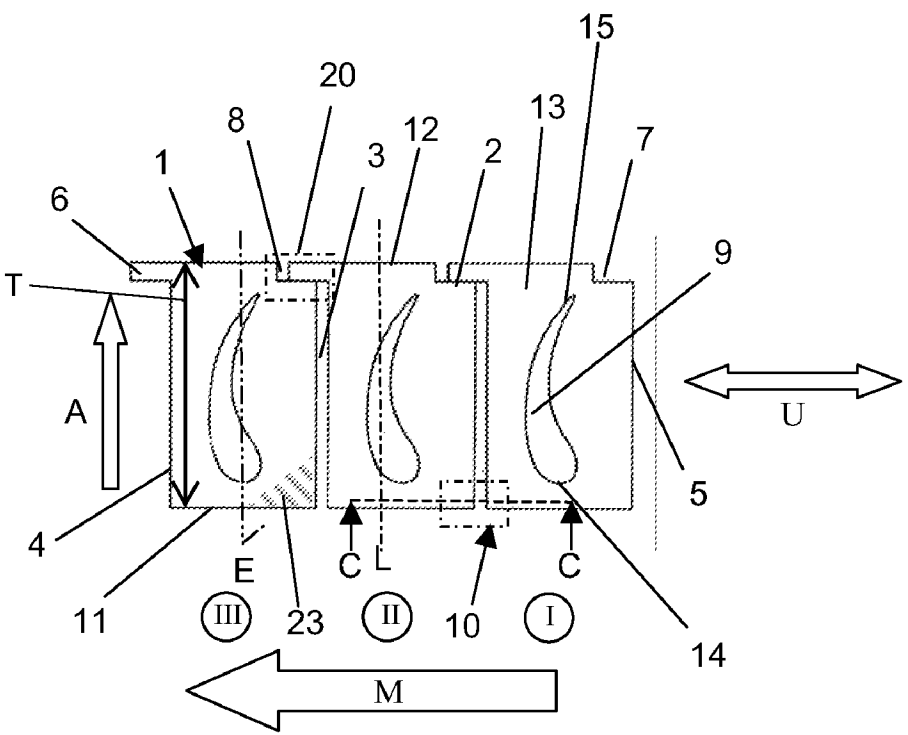
Fig. 1a (Prior Art)

FIG. 1*a* shows an arrangement of turbine blades as an unrolled section of a blade row in plan view of the shroud surface 23, wherein three contiguous blade elements are shown. One blade element 1 has a shroud element 13 and also a blade airfoil 9 which abuts on, and is connected to, this shroud element 13, and extends essentially in the radial direction with regard to a principal axis of the blade row. The principal axis of the blade row is that axis around which the circular cylinder which is defined by an installed blade row is formed. The principal axis of the blade row, for example in the case of installed rotor blades in a rotor of a gas turbine, represents the axis around which the circular cylindrically arranged rotor blades rotate.

The blade airfoil 9 has an axially front blade inlet edge 14 and an axially rear blade outlet edge 15. The blade inlet edge 14, in the inflow direction A from the first axial edge or the leading edge 11, is first of all exposed to circumflow by the airflow of the operating medium which flows in the operating medium region R. The operating medium then flows around the blade airfoil 9 and leaves it at the blade outlet edge 15 in the direction of the second axial edge or trailing edge 12.

With the blade row installed, the shroud element 13, by the two sides 4, 5 which point in the circumferential direction U, abuts on the respectively adjacent shroud element 13 of the respectively adjacent blade element 1, forming an essentially radial gap 3 in each case. In FIG. 1*a*, the blade elements 1 with only one shroud element 13 each are shown. However, it is also conceivable for the blade elements 1 to have both a radially inner and a radially outer shroud element 13.

Each blade element 1 in the circumferential direction U has a first side 4 which points in the installation direction M, and a second side 5 which points opposite to the installation direction M. The first circumferential side 4, which points in the installation direction M, of an installed blade element 1, as a result of the installation of a following blade element 1 comes to lie against the second circumferential side 5, which points opposite to the installation direction M, of the blade element 1 which is installed next.

The first installed blade element, which is identified by "I", as well as all the following blade elements 1, has a projection 6 on an axial edge 12 on a first side 4 which points in the circumferential direction U, which projection points forwards in the installation direction M, extends in the circumferential direction U and projects into the shroud element 13 of the adjacent blade element 1. Also, the displayed blade elements 1, on a second side 5, which points in the circumferential direction U, have a corresponding recess 7 which accommodates this projection 6. The width B of the projection 6, measured in the radial direction, is 40% maximum, preferably 20% maximum, especially preferably 5-15%, of the installed depth T of a blade element 1. The installed depth T is defined by the axial distance between the leading edge 11 and the trailing edge 12 of the blade element 1.

The projection 6 is to be understood as an offset in the circumferential direction U beyond a part of the axial extent of a circumferential side 4 of a blade element 1.

In particular, the projection 6, with regard to the longitudinal axis L of a blade airfoil 9, defines a stepped radial gap 3 between two adjacent installed blade elements 1 in a plane which is defined by the shroud surface 23, the gap extending from the axial leading edge 11 of a blade element 1 to the axial trailing edge 12 in a radial plane E between the adjacent sides 4, 5 of the individual blade elements. In the installed state, the abutting of the blade elements 1 in a stepped overlapping or engagement region 2 between the shrouds of adjacent blade elements results, as a result of which the radial gap 3 is sealed against the escape of cooling air. Without such a stepped arrangement 2, the air which gets into the radial gap 3 would escape unhindered from the opening 8 at the axial trailing edge 12 and would therefore be lost to the system.

FIG. 1*b* shows a schematic detailed view of a stepped overlapping region according to the prior art. The zigzag shape of the radial gap 3 which results from the overlaying of the shrouds of the two adjacent blade elements is evident here. Such an arrangement with two changes of direction deflects the cooling air which got into the radial gap 3 from the cooling air region and contributes to the reducing of the leakage flow at the trailing edge of the blade element. The conventional shiplap, in accordance with the figure, therefore has two changes of direction in the region of an angle $\alpha$ of essentially 90 degrees, with regard to the course of the radial gap 3. Such a stepped overlapping region according to the prior art has an essentially constant gap width in the stepped region over the entire course of the radial gap.

Figure 2:
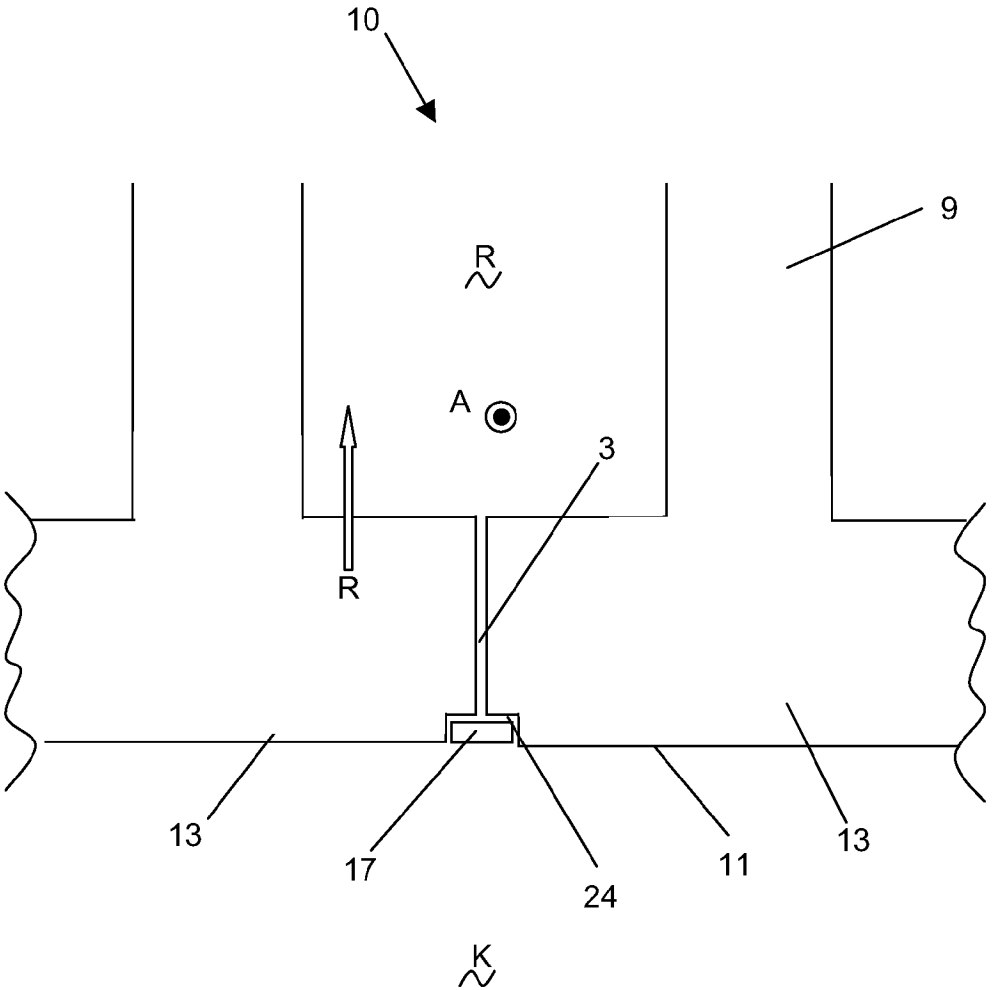
Fig. 2 (Prior Art)
FIG. 2: shows a schematic view of a section along the line C-C of the detail 10 of the region between two adjacent blade elements 1, as seen from the inflow direction A.

In FIG. 2, the region 10, which is indicated in FIG. 1*a*, between two adjacent blade elements 1 on a first axial edge or leading edge 11 is schematically shown in a section perpendicular to the principal axis of the blade row along the line C-C which is indicated in FIG. 1*a*. A detail of two adjacent shroud elements 13 with their associated blade airfoils 9 is shown. In the figure, the cooling air region K is shown beneath the shroud elements 13, and between the two blade airfoils 9 the region R of the operating medium is shown, designated by the flow direction of the operating medium. The entry of cooling air into the radial gap 3 which extends between the two shroud bands 13 and the axial distribution of the air in the radial gap 3 is impeded in this exemplary embodiment by means of a sealing plate 17. For sealing the radial gap 3, the sealing plate 17 lies in a gap-overlapping manner in a recess 24 or step in each case of two adjacent shrouds in the circumferential direction U of the shroud underside, or engages in these steps or recesses 24 and extends in its length along the radial gap 3, parallel to a plane which is defined by the shroud surface, up to the stepped region 2 at the trailing edge 12 of the shroud element 13. As a result of centrifugal force, the sealing plate strip 17, which engages in the two recesses 24 of the adjacent shroud elements 13, is held in its position. While the shiplap arrangement or the stepped region 2 has the task of reducing the axial components of the leakage flow at the outlet from the radial gap 3 at the trailing edge 12, this sealing plate 17 has the function of trapping the radial components of the leakage flow, i.e. of preventing the radial entry of cooling air from the cooling air region K into the radial gap 3 and consequently also of preventing the first step for propagation of the gap flow in the axial direction. This sealing plate 17, however, no longer completely covers the radial gap in the stepped region of the shiplap in the radial direction, which is why in the shiplap region 20 a relatively large amount of cooling air from the cooling air region K can still enter the radial gap 3. In the present invention, it is therefore a question inter alia of minimizing the escape of air from the radial gap 3 which got into the said radial gap 3 despite sealing means, such as the sealing plate 17 in this case.

FIG. 3 shows different preferred exemplary embodiments of shiplap arrangements, which are designed as labyrinth seals, as a schematic view of the detail 20 which is indicated in FIG. 1*a*. In this case, with the exception of the shiplap which is shown in FIG. 3*d* with only a single step, shiplaps with a multistep labyrinth seal within the meaning of the invention are shown in each case, for example with 4 changes of direction, which, however, is not to exclude the availability of further labyrinth steps, i.e. of 2 and more additional changes of direction. In all the exemplary embodiments of the labyrinth seal which are shown, sections of the radial gap 3 which extend parallel to or obliquely to the flow direction A essentially alternate with such sections which are arranged transversely to the inflow direction A. It is conceivable, however, that in the stepped region of the gap 3 provision is made for only sections which are angled to the flow direction A, or only the combination of sections which are parallel to the flow direction A and such sections which are perpendicular to it.

Figure 3A:
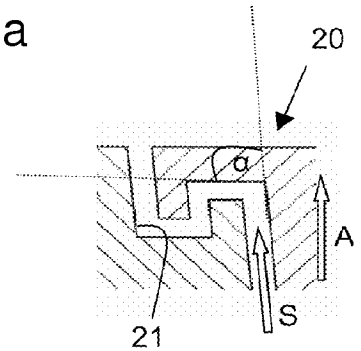
FIGS. 3*a*-3*f*: show five different variants of possible geometries of labyrinth seals in a detailed view 20 of the stepped region 2 from FIG. 1.

FIG. 3*a* shows a zigzag shape of the radial gap 3 in the stepped region 2. The zigzag shape of the gap 3 is achieved by two changes of direction in the clockwise direction following two changes of direction in the counterclockwise direction. Alternatively, the case could also be reversed. The gap flow in the gap 3, as seen from the leading edge 11 in a section after the two changes of direction in the counterclockwise direction, flows opposite to the inflow direction A. Although in this case only one such phase is shown, in the case of a higher number of changes of direction in the stepped region 2 a plurality of such sections which extend opposite to the inflow direction A are conceivable. The current exemplary embodiment has four changes of direction of the radial gap 3, of which the first of the two changes of direction, as seen from the leading edge 11 to the trailing edge 12, are arranged in the counterclockwise direction, and the next two are arranged in the clockwise direction. According to this exemplary embodiment, the air flows in the radial gap first of all parallel to the flow direction A, whereupon for one section it flows transversely to the flow direction A, then opposite to the flow direction A, and then again flows transversely to it before the geometry of the radial gap 3 allows it to flow in the flow direction A again. In FIG. 3*a*, therefore, the gap flow S of the cooling air coming from the leading edge 11 and directed towards the trailing edge 12 enters the stepped region 2 essentially parallel to the inflow direction A. According to the view, the cooling air is subsequently deflected twice by about 90 degrees in the counterclockwise direction, in order to then twice experience a change of direction by about 90 degrees in the clockwise direction before that cooling air, which despite the stepped arrangement as a labyrinth seal was not stopped from flowing as far as the trailing edge 12, escapes from the radial gap 3 at the trailing edge 12. The preferred embodiment which is shown in FIG. 3*a* has straight boundary surfaces 21 which abut on each other in an angled manner at specific angles $\alpha$. In such an arrangement, the boundary surfaces 21, however, could easily also abut on each other by means of concave or convex boundary surface shapes, by "round corners" so to speak. It is also conceivable that the radial gap 3 could have other angle values $\alpha$ in this arrangement of changes of direction.

Figure 3B:
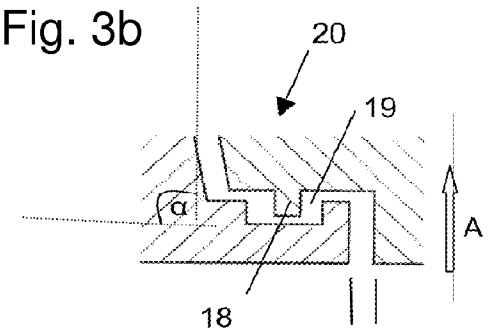

The exemplary embodiment of a labyrinth seal which is shown in FIG. 3*b* also shows a radial gap 3 which in the stepped region 2 exclusively comprises straight boundary surfaces 21. The regions of the changes of direction are all formed in an angled manner in this exemplary embodiment. The gap flow S of the cooling air, after entry into the stepped region 2 parallel to the inflow direction A enters a narrowed gap region 18 during the first change of direction which is about 90 degrees in the counterclockwise direction, whereupon the gap flow is deflected by about 90 degrees in the clockwise direction into a widened region 19, and is then deflected again by about 90 degrees in the counterclockwise direction into a narrowed region 18 in order to then experience one more deflection by about 90 degrees in the counterclockwise direction before the air, after two further changes of direction in the clockwise direction, essentially by about 90 degrees, reaches the outlet opening 8 at the trailing edge 12 of the blade element 1.

Figure 3C:
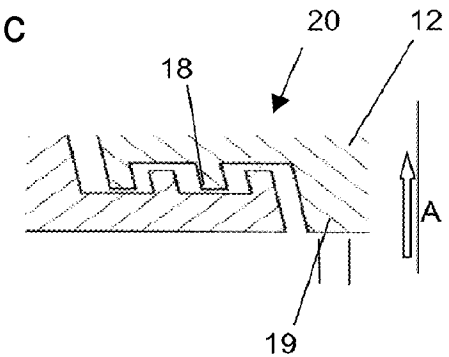

In FIG. 3*c*, as previously in FIG. 3*b*, a labyrinth seal is shown, in which the radial gap 3 in the straight boundary surfaces 21 which are arranged transversely to the flow direction A is narrower than in the boundary surfaces 21 which are arranged parallel to the flow direction A. In this case, the stepped region has eight changes of direction, wherein in the gap flow direction S two changes of direction in the counterclockwise direction are first of all arranged, followed by two changes of direction in the clockwise direction, then two changes of direction in the counterclockwise direction again, and finally two changes of direction in the clockwise direction. The first change of direction in the counterclockwise direction is essentially 60-70 degrees. The second change of direction in the counterclockwise direction is about 100-110 degrees, as also the following change of direction, arranged in the clockwise direction, of the radial gap 3. The ensuing change of direction in the clockwise direction is again about 60-70 degrees, as also the subsequent change of direction in the counterclockwise direction. Following this is a change of direction in the counterclockwise direction by about 100-110 degrees and then two changes of direction in the clockwise direction, of which the first is also about 100-110 degrees and the second about 60-70 degrees. The radial gap 3, according to the view, in this case has two consecutive angled U-shaped sections which are open at the top (in the flow direction) and two angled U-shaped sections which are open at the bottom.

The zigzag shape of the labyrinth seals with more than two changes of direction, as shown in FIGS. 3*a-c*, are distinguished inter alia by the fact that the gap flow S of the cooling air, in conformance with the geometry of the labyrinth seal inside the radial gap 3, is also forced in sections into a direction which is opposite to the overall flow direction A, and by the fact that the gap flow S in the course of the stepped region 2 experiences intense swirling, wherein the quotient between the throughflow cross section or the width of the radial gap in a narrowing and the throughflow cross section in the region which follows the narrowing influences the degree of swirling.

In general, it is to be mentioned that the boundary surfaces 21, regardless of how they are represented in the Figures, can extend parallel to the inflow direction A, transversely to it, or obliquely to it, i.e. angled to the flow direction. These boundary surfaces 21 can be formed plane or straight, or rounded, either convexly, i.e. as projections into the radial gap, or concavely, i.e. as widenings from the radial gap 3 into the shroud element 13. By the same token, the boundary surfaces 21, in the case of a change of direction of the radial gap 3, can abut on each other at specific angles in an angled manner and/or along rounded boundary surfaces 21.

Figure 3D:
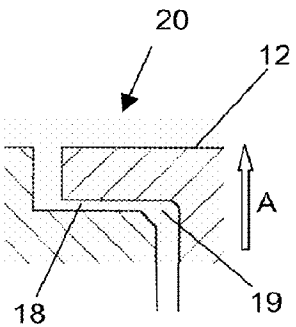

FIG. 3*d* shows an exemplary embodiment of a labyrinth seal which actually has only two changes of direction but compared with a simple shiplap has a region with a widening 19 and a narrowing 18 each in the radial gap 3 in addition to the two changes of direction of the radial gap 3. Such a sequence of a widening 19 in the region of the change of direction, followed by a narrowed gap section 18, or vice versa, also acts upon the gap flow with velocity-throttling effect, which is certainly desirable for the purpose of minimizing the leakage flow. The two changes of direction, of which one is formed in the counterclockwise direction and the second in the clockwise direction, are both essentially about 90 degrees. The region of the first change of direction in the stepped region 2 is formed according to the view as a "rounded corner", or rounded widened triangular region, whereas the second change of direction region is configured as a conventional corner. A widening 19 may be defined as a section of the radial gap 3 in the stepped region 2 in which the width of the radial gap 3, i.e. of the throughflow cross section, is at least 30% more, preferably at least 50% more, than the gap width D, or is even twice as large. A narrowing 18 may be defined as a section of the radial gap 3 in the stepped region 2 in which the width of the radial gap 3, or of the throughflow cross section, is 50%, preferably 25-50% of the gap width D. That is to say that the ratio between the gap width D and the width of the gap, i.e. the quotient between the width of the gap in the narrowing 18 and the gap width D at the entry of the radial gap 3 into the stepped region 2 is essentially between 1:2 and 1:4, possibly even up to 1:8.

Figure 3E:
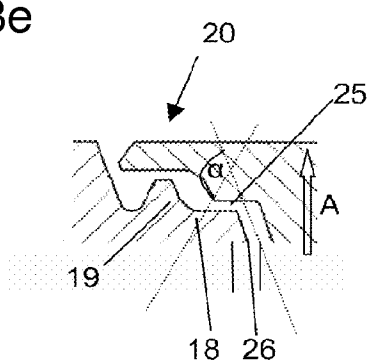

The labyrinth seal according to the exemplary embodiment which is shown in FIG. 3*e* has predominantly rounded boundary surfaces 21. After air in the gap flow S, as seen from the leading edge 11 in the direction of the trailing edge 12, flows into the stepped region 2 via a conical narrowing 26 which is shown according to this exemplary embodiment, it reaches a widened triangular region 25 with rounded boundary surfaces 21, on the boundary surfaces 21 of which, which delimit the radial gap 3, the airflow is substantially deflected and swirled, in this case by about 130 degrees in the counterclockwise direction, before it is pushed, with a change of direction in the clockwise direction by about 50-60 degrees, into a narrowed section 18 of the radial gap 3 which is arranged transversely to the inflow direction A of the blade elements 1. The cooling air flow which flows in the radial gap 3 then experiences a deflection by about 40-50 degrees in the clockwise direction into a second widening 19 in order to then experience again a deflection in the counterclockwise direction by about 50-60 degrees into a gap region 18 which is again narrowed, before it can escape, after a further deflection by about 70-85 degrees in the clockwise direction, from the radial gap 3 at the trailing edge 12.

Figure 3F:
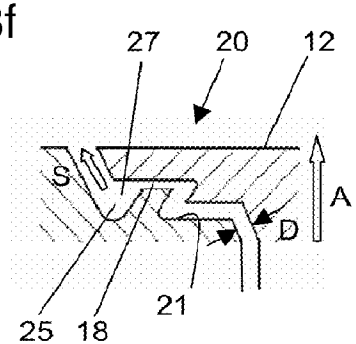

In the labyrinth seal according to the exemplary embodiment from FIG. 3*f*, in the gap flow S of cooling air after entry into the stepped region 2, the boundary surfaces 21 which delimit the radial gap 3 first of all abut on each other in an angled manner via two changes of direction, while the radial gap 3 in the region of the stepped region 2 which adjoins it also has rounded abutting of the boundary surfaces 21 during a change of direction. The radial gap 3 in the labyrinth seal which is shown in FIG. 3*f*, in a first half with regard to the direction of the gap flow S, has an essentially uniform width D, while the second half, along a plane surface, first of all has a region 18 which is narrowed in comparison to the first labyrinth step, and then a widening 19. The gap flow S which enters the stepped region 2 according to this exemplary embodiment is first of all only slightly deflected by an angle $\alpha$ of about 30 degrees in the counterclockwise direction, before it experiences a significant deflection of essentially 90 degrees in the clockwise direction for the purpose of vortex formation and velocity throttling, is then deflected by a significant 130-140 degrees in the clockwise direction into a following section of the radial gap 3, and then, again by about 130-140 degrees but this time in the counterclockwise direction, is squeezed into a narrowed gap region 18 which extends essentially transversely to the inflow direction A, so as to then, in a conical widening 27 by an angle $\alpha$ of about 50-70 degrees, be expanded again into a rounded triangular region 25, on the rounded boundary surfaces 21 of which the airflow is guided by about 50-70 degrees towards the outlet at the second axial edge or the trailing edge 12.

Figure 4B:
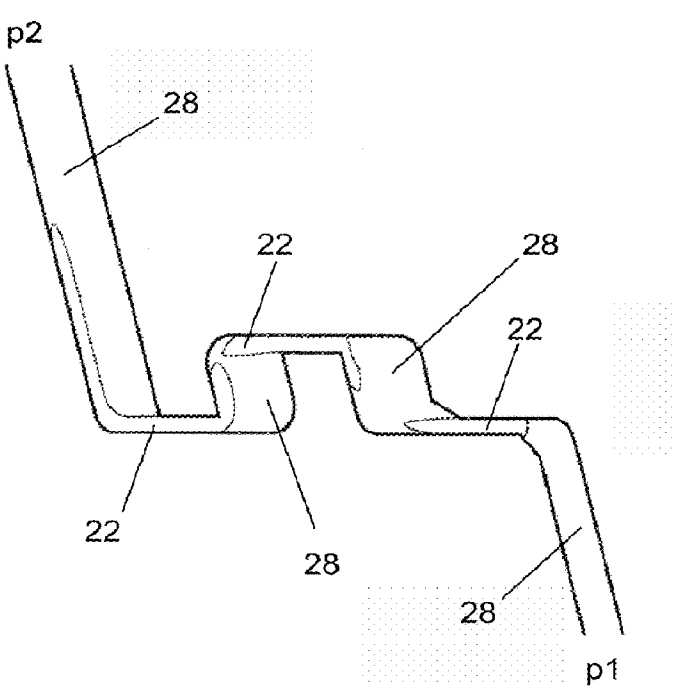
FIGS. 4*a* and 4*b*: show a 2D CFD (two-dimensional computational fluid dynamics) calculation result as a comparison between a simple labyrinth seal (FIG. 4*a*) and a further preferred exemplary embodiment of the present invention (FIG. 4*b*) for expressing the absolute values of the flow velocities.
Figure 4A:
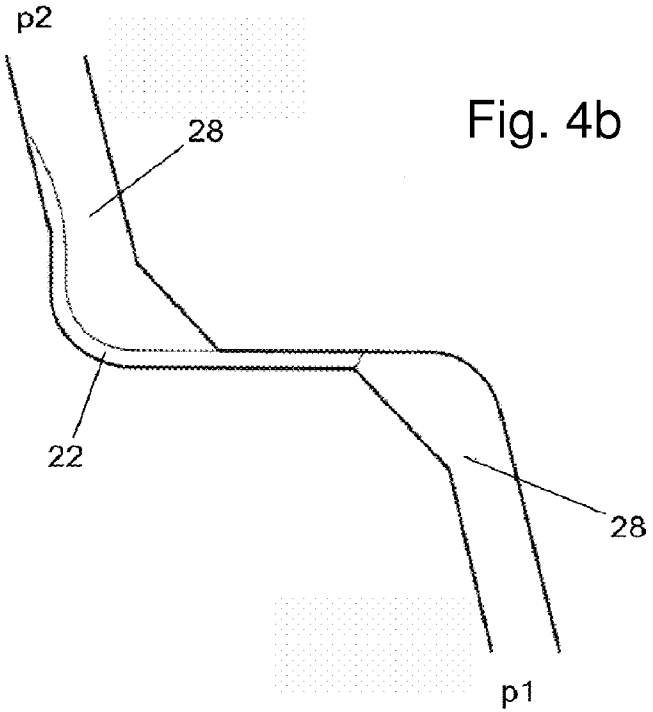

In FIG. 4, two contour views of the absolute values of the flow velocities of the cooling air in the radial gap 3 in the stepped region 2 are shown. The figure shows in a 2D CFD depiction calculation results of tests of a first labyrinth seal (FIG. 4*a*) within the meaning of the exemplary embodiment which is shown in FIG. 3*d* in comparison to an even further improved labyrinth seal (FIG. 4*b*). The marked regions 22, 28 are defined by their flow velocity. The region 22 is defined as the region with high flow velocity since the flow velocity is higher than that of the airflow during entry into the stepped region 2. The entry region into the stepped region 2, as also the region of the outlet from the stepped region 2, is associated with the region 28 which therefore has a lower flow velocity than the region 22. In FIG. 4*a*, the regions 28 have a flow velocity which is essentially approximately twice as high as the flow velocity in the said regions 28 of the exemplary embodiment which is shown in FIG. 4*b*. FIG. 4*a* has only one region 22 with high flow velocity. The arrangement which is shown in FIG. 4*b*, on the other hand, on account of its additional stepping, has three such regions 22 with high flow velocity in which the cooling air has a higher flow velocity than the entry velocity in the radial gap. The flow velocity which is achieved in these regions, however, has flow velocities which are approximately half as high in comparison to the region 22 which is indicated in FIG. 4*a*. Both the lower limit and the upper limit of the flow velocity in the indicated region 22 from FIG. 4*a* are essentially approximately double the corresponding lower limit or upper limit of the said regions 22 from FIG. 4*b*. Such regions 22 are preferred since as a result of a lowered flow velocity the mass flow is reduced. The entry pressure p1 of the cooling air in the radial gap 3 coming from the leading edge 11 into the stepped region 2 is higher in the case of the shiplap arrangement according to FIG. 4*a* than the pressure p2 at the outlet from the stepped region 2. With essentially the same conditions, however, in the preferred exemplary embodiment which is shown in FIG. 4*b*, with six changes of direction in the radial gap 3 at an angle α of essentially 90 degrees each, the mass flow is essentially halved.

LIST OF DESIGNATIONS

1 Blade element
2 Shiplap, stepped region
3 Radial gap
4 First circumferential side
5 Second circumferential side
6 Projection
7 Recess
8 Opening
9 Blade airfoil
10 Detail of the region between two blade elements at the leading edge
11 First axial edge, leading edge
12 Second axial edge, trailing edge
13 Shroud element
14 Blade inlet edge
15 Blade outlet edge
17 Sealing plate
18 Narrowing
19 Widening
20 Detail along section C-C
21 Boundary surface of 3
22 Region of 3 with high flow velocity in the region of 2
23 Surface of 13
24 Recess
25 Rounded triangular region
26 Conical narrowing
27 Conical widening
28 Region of 3 with low flow velocity in the region of 2
α Angle of the change of direction
A Inflow direction (flow direction of the operating medium)
B Width of 6
C-C Intersection line
D Gap width, throughflow cross section
E Radial plane
K Cooling air region
L Longitudinal axis of 9
M Installation sequence or installation direction
p1 Entry pressure of the cooling air flow
p2 Exit pressure of the cooling air flow
R Operating medium region
S Gap flow direction
T Installed depth
U Circumferential direction

What is claimed is:

1. An arrangement between blade elements (1) in a blade row in a gas turbine, each blade element (1) has at least one shroud element (13), and also a blade airfoil (9) which abuts on, and is connected to, the shroud element (13), and extends essentially in the radial direction with regard to a principal axis of the blade row, with the blade row installed, the shroud element (13), by two sides (4, 5) which point in the circumferential direction (U), abut on a respectively adjacent shroud element (13) of the respectively adjacent blade element, forming an essentially radial gap (3) in each case, and at least one blade element (1), on a first side (4) which points in the circumferential direction (U), has a projection (6) which projects into the shroud element (13) of the abutting blade element (1) and extends in the circumferential direction (U), and at least one blade element (1), on a second side (5) which points in the circumferential direction (U), has a recess (7) which accommodates such a projection (6), wherein in the region of the projection (6) or of the recess (7) there is a stepped region (2) of the radial gap, the guiding of the radial gap (3) in the stepped region (2) is a labyrinth seal and the radial gap (3) in the stepped region (2) has at least one narrowing (18) and/or at least one widening (19) and has more than two changes of direction in the stepped region.

2. The arrangement as claimed in claim 1, wherein the radial gap (3) in the stepped region (2) has changes of direction at an angle (α) in the range of 40 to 130 degrees.

3. The arrangement as claimed in claim 1, wherein the radial gap (3) has angled and/or rounded boundary surfaces (21).

4. The arrangement as claimed in claim 1, wherein the radial gap (3) has concave and/or convex, and/or straight boundary surfaces (21).

5. The arrangement as claimed in claim 1, wherein the radial gap (3) during its course in the stepped region (2) experiences two changes of direction in the same direction in each case one after the other.

6. The arrangement as claimed in claim 1, wherein the radial gap (3) in the stepped region (2) has at least one section in which a gap flow direction (S) extends opposite to an inflow direction (A).

7. The arrangement as claimed in claim 1, wherein a width or a throughflow cross section of the radial gap (3) in a section of a widening (19) is at least 30% more than the width (D) or of the throughflow cross section of the radial gap (3) at the entry into the stepped region (2), or is even twice as large, and in the section of a narrowing (18) the width or the throughflow cross section of the radial gap (3) is 75%-50% of the gap width (D) or of the throughflow cross section at the entry into the stepped region (2).

8. The arrangement as claimed in claim 1, wherein in the stepped region (2) of the radial gap (3), in a direction from a first axial edge (11) to a second axial edge (12), a widening (19) and/or a narrowing (18) is arranged before and/or after a change of direction.

9. The arrangement as claimed in claim 1, wherein in the stepped region (2) of the radial gap (3), in a direction from a first axial edge (11) to a second axial edge (12), a widening (19) is arranged after a narrowing (18).

10. The arrangement as claimed in claim 1, wherein in the stepped region (2) of the radial gap (3) the region of the change of direction is designed as a widening (19) or narrowing (18).

11. The arrangement as claimed in claim 1, wherein in the stepped region (2) of the radial gap (3) the region of the change of direction has rounded triangular regions (25).

12. A blade row of a gas turbine comprising a plurality of blade elements (1) wherein each blade element (1) has at least one shroud element (13), and also a blade airfoil (9) which abuts on, and is connected to, the shroud element (13), and extends essentially in the radial direction with regard to a principal axis of the blade row, with the blade row installed the shroud element (13), by two sides (4, 5) which point in the circumferential direction (U), abut on the respectively adjacent shroud element (13) of the respectively adjacent blade element, forming an essentially radial gap (3) in each case, and at least one blade element (1), on a first side (4) which points in the circumferential direction (U), has a projection (6) which projects into the shroud element (13) of the abutting blade element (1) and extends in the circumferential direction (U), and at least one blade element (1), on a second side (5) which points in the circumferential direction (U), has a recess (7) which accommodates such a projection (6), wherein in the region of the projection (6) or of the recess (7) there is a stepped region (2) of the radial gap, the guiding of the radial gap (3) in the stepped region (2) is a labyrinth seal and the radial gap (3) in the stepped region (2) has at least one narrowing (18) and/or at least one widening (19) and has four, six, or eight changes of direction in the stepped region.

13. The arrangement as claimed in claim 12, wherein the radial gap (3) in the stepped region (2) has changes of direction at an angle ($\alpha$) in the range of 40 to 130 degrees.

14. The arrangement as claimed in claim 12, wherein the radial gap (3) has angled and/or rounded boundary surfaces (21).

15. The arrangement as claimed in claim 12, wherein the radial gap (3) has concave and/or convex, and/or straight boundary surfaces (21).

16. The arrangement as claimed in claim 12, wherein the radial gap (3) during its course in the stepped region (2) experiences two changes of direction in the same direction in each case one after the other.

17. The arrangement as claimed in claim 12, wherein the radial gap (3) in the stepped region (2) has at least one section in which a gap flow direction (S) extends opposite to an inflow direction (A).

18. The arrangement as claimed in claim 12, wherein a width or a throughflow cross section of the radial gap (3) in a section of a widening (19) is at least 30% more than the width (D) or of the throughflow cross section of the radial gap (3) at the entry into the stepped region (2), or is even twice as large, and in the section of a narrowing (18) the width or the throughflow cross section of the radial gap (3) is 75%-50% of the gap width (D) or of the throughflow cross section at the entry into the stepped region (2).

19. The arrangement as claimed in claim 12, wherein in the stepped region (2) of the radial gap (3), in a direction from a first axial edge (11) to a second axial edge (12), a widening (19) and/or a narrowing (18) is arranged before and/or after a change of direction.

20. The arrangement as claimed in claim 12, wherein in the stepped region (2) of the radial gap (3), in a direction from a first axial edge (11) to a second axial edge (12), a widening (19) is arranged after a narrowing (18).

21. The arrangement as claimed in claim 12, wherein in the stepped region (2) of the radial gap (3) the region of the change of direction is designed as a widening (19) or narrowing (18).

22. The arrangement as claimed in claim 12, wherein in the stepped region (2) of the radial gap (3) the region of the change of direction has rounded triangular regions (25).

* * * * *